United States Patent [19]

Pettit et al.

[11] Patent Number: 4,756,453

[45] Date of Patent: Jul. 12, 1988

[54] STOCKING ASSIST DEVICE

[76] Inventors: John J. Pettit, Box 54, Penn Estates, East Stroudsburg, Pa. 18301; Frank Pettit, 696 Fairway Dr., Union, N.J. 07083

[21] Appl. No.: 72,435

[22] Filed: Jul. 13, 1987

[51] Int. Cl.[4] ..... A47G 25/90

[52] U.S. Cl. ..... 223/111; 223/113

[58] Field of Search ..... D2/641, 642; 223/111, 223/112, 113, 114, 115, 116, 117, 118, 119

[56] References Cited

U.S. PATENT DOCUMENTS

| | | | |
|---|---|---|---|
| 28,927 | 6/1860 | Wheeler | 223/114 X |
| 403,585 | 5/1889 | Hackett | 223/116 |
| 1,315,096 | 9/1919 | Deiley | 223/111 |
| 2,828,057 | 3/1958 | MacLauchlan | 223/111 |
| 2,919,840 | 1/1960 | Hongland | 223/111 |
| 3,070,271 | 12/1962 | Kennedy, Sr. | 223/111 |
| 3,860,156 | 1/1975 | Lawrence | 223/111 |
| 4,066,194 | 1/1978 | Leland | 223/111 |
| 4,238,061 | 12/1980 | Marchetti et al. | 223/111 |

FOREIGN PATENT DOCUMENTS

| | | | |
|---|---|---|---|
| 107303 | 1/1900 | Fed. Rep. of Germany | 223/116 |
| 1265155 | 5/1961 | France | 223/114 |
| 2316903 | 2/1977 | France | 223/111 |

*Primary Examiner*—Robert R. Mackey

*Attorney, Agent, or Firm*—Ruth Moyerman; Harvey D. Fried

[57] ABSTRACT

A device to assist a person with putting on stockings, or other hosiery, includes a pair of posts connected by a hinge. Each post is fitted with a hosiery inversion arm. A user places a sock, or the like hose, over both arms, the top inverted and the sock toe extending downward between the arms. The user then spreads the posts apart to stretch the sock open and pushes a foot into the open sock, the sock unfolding as it is mounted on the foot.

14 Claims, 2 Drawing Sheets

STOCKING ASSIST DEVICE

BACKGROUND OF THE INVENTION

1. Field of the Invention

This invention relates to apparel apparatus and, more particularly, to apparatus to aid in dressing or removing garments.

2. Description of the Prior Art

There are many persons who, for various reasons, cannot easily bend or move their backs. These persons have difficulty performing many daily functions, and perhaps one of the most frustrating is the task of putting on socks or other hosiery. Donning hosiery requires bending the back and pulling with the arms, both of which require a degree of agility and back strength which persons with rigid backs or other orthopedic problems often lack.

There is, therefore, a need for a device which will aid in donning hosiery and which does not require bending or pulling or assistance by another person.

SUMMARY OF THE INVENTION

The aforementioned prior art problems are obviated by the stocking assist device of this invention. It should be noted that by stocking is meant men's, women's and children's hosiery of different types, including, but not limited to socks, stockings, and sock slippers. A pair of preferably hollow support posts includes, preferably, interior telescoping rods at their proximal ends and hinges at their distal ends. Each post is fitted with a hosiery inversion arm, the arm preferably an open ended elliptical loop, with the open end attached to the post and the loop facing the other post. In use, a sock (or other piece of hosiery) is placed over both facing hosiery inversion arms, the sock top inverted over the arms to form a cup, the sock toe extending downward between the arms. The user, grasping the posts at their proximal ends, spreads the posts apart to widen the opening of the sock and pushes his foot downward into the sock, the sock unfolding as the foot pushes downward. As the user pushes farther into the sock, he spreads the posts further apart to stretch the hose further and provide for the larger dimension of his calf. The user does not need to pull on the sock or lift his leg any great distance. Non-slip end caps may be provided and optional boot hooks may be added to the posts above the hosiery inversion arms.

It is, therefore, an object of this invention to provide a stocking assist device which does not, in use, require the user to bend his back.

It is another object of this invention to provide a stocking assist device which employs hosiery inversion arms which provide for a pushing motion of the leg rather than a pulling motion of the arms.

It is yet another object of this invention to provide a stocking assist device which includes telescoping support posts to accommodate users of different heights.

It is still another object of this invention to provide a stocking assist device which is light weight and simple to operate.

It is a further object of this invention to provide a stocking assist device which utilizes the elasticity of hosiery to provide easy fit for legs of different sizes.

It is a further object of this invention to provide a stocking assist device which is useful with hosiery of any size or type.

It is yet another object of this invention to provide a stocking assist device which includes boot hooks to aid in the mounting of a boot on a person's foot.

These and other objects will be more readily ascertainable to one skilled in the art from a consideration of the following figures, description and exemplary embodiments.

BRIEF DESCRIPTION OF THE DRAWING(S)

Figure 2:
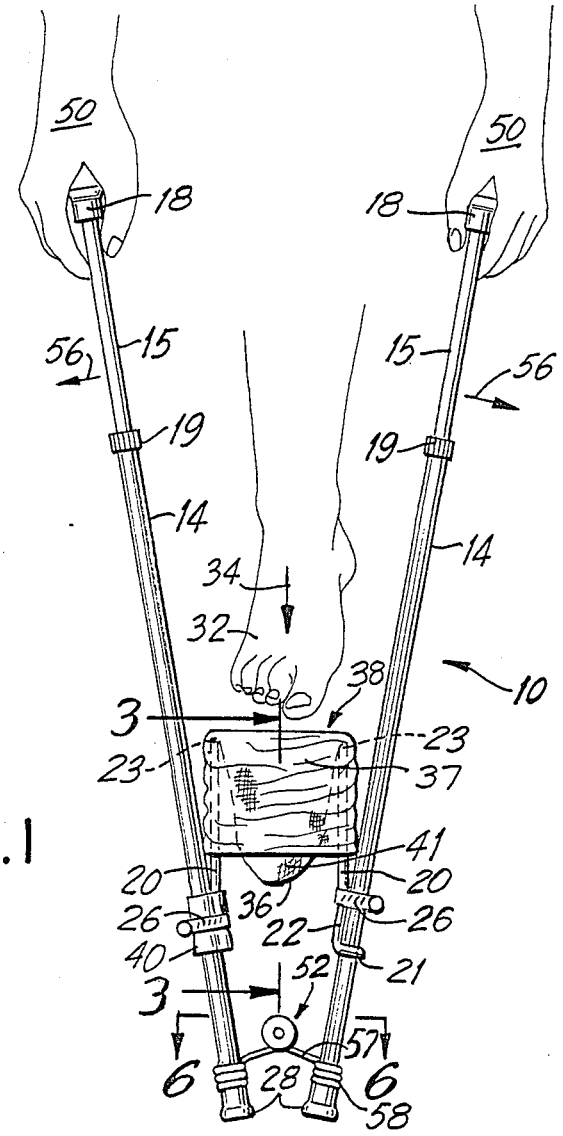
FIG. 2 illustrates the device with an alternative hinge arrangement and partially shows a person using the device.
Figure 3:
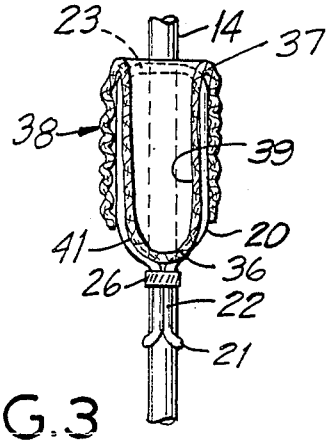

FIG. 3, taken on lines 3—3 of FIG. 2, is a cross section and enlargement of a sock in place on the hosiery inversion loop.

Figure 4:
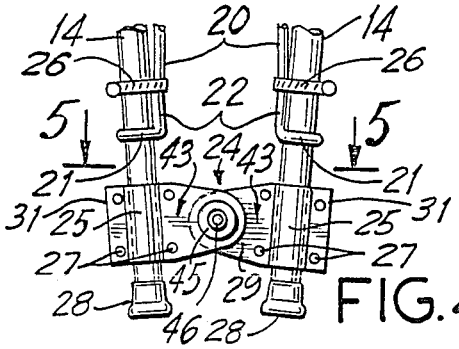

FIG. 4 is an enlargement of a hinge of this invention.

Figure 5:
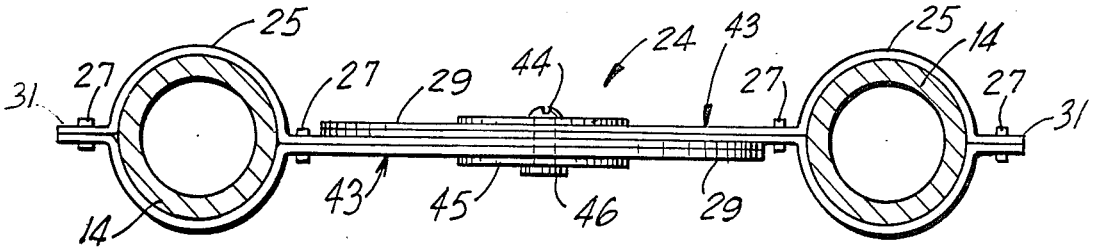

FIG. 5 is a top view of the preferred hinge taken on lines 5—5 of FIG. 4.

Figure 6:
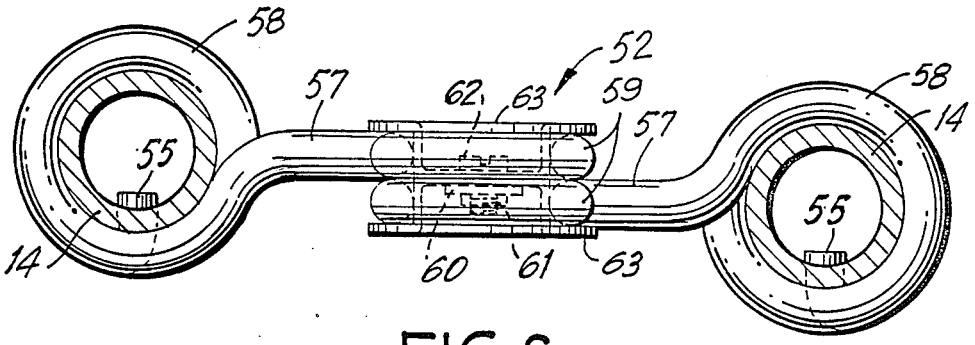

FIG. 6 is a top view taken on lines 6—6 of FIG. 2 illustrating the alternative hinge arrangement.

Figure 1:
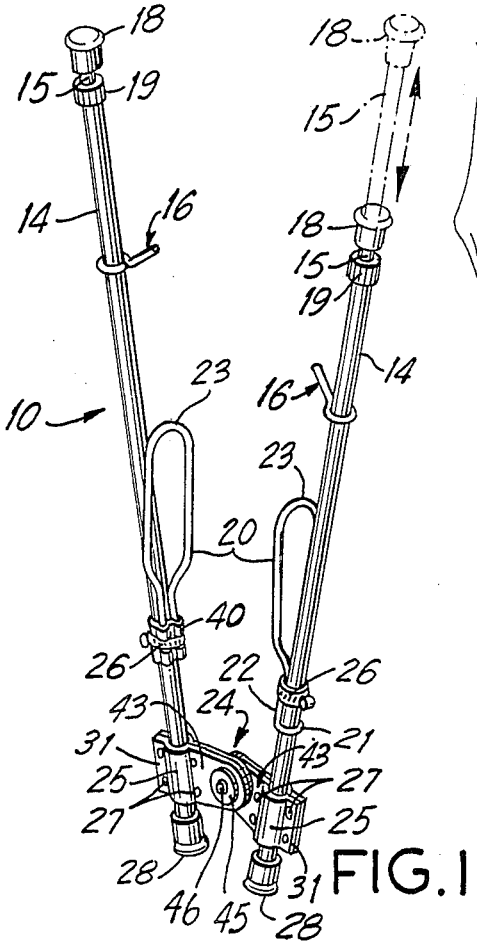
FIG. 1 is an isometric view which illustrates the preferred embodiment of the stocking assist device of this invention, including optional boot hooks.
Figure 7:
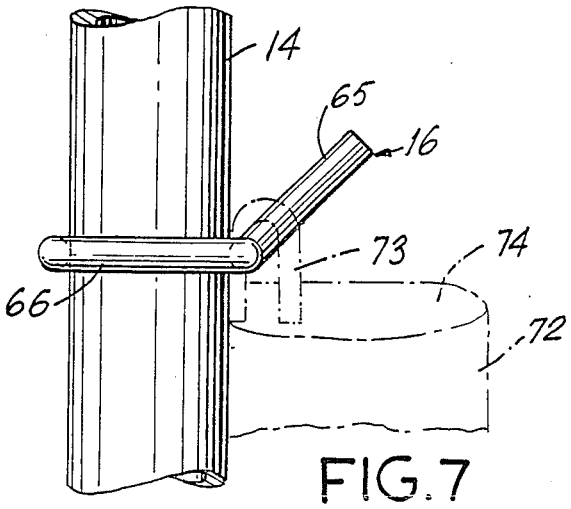

FIG. 7 is an enlargement of the boot hook of FIG. 1.

DETAILED DESCRIPTION OF THE PREFERRED EMBODIMENT(S)

Referring now to the drawings, and more particularly to FIGS. 1 and 4, stocking assist device 10 is illustrated with posts 14, hosiery inversion loops 20 and hinge 24. Posts 14 each include, at their proximal ends, interior telescoping post 15 which is held in a predetermined position by locking coupler 19. Because stocking assist device 10 is intended to be used by persons who are unable to bend their backs, it is very desirable that the device be adjustable for varying heights of the users. This adjustability is provided by telescoping posts 14 and 15, which is well known in the art. Other methods of extending the length of the posts are possible, but telescoping posts are preferred as simple to manufacture and assemble.

Hosiery inversion arms 20 are loops attached by ring clamps 26 in juxtaposed and parallel position on facing sides of posts 14. For ease of manufacture, arms 20 are preferably metal elongated presized loops with rounded tops 23, but other constructions such as solid paddles may be substituted. Arms 20 provide for inversion of the hosiery, which will be further described with reference to FIG. 2.

Extensions 22 of arms 20 also may be of several embodiments, and two embodiments are shown in FIG. 1. The first embodiment is illustrated with two leg extensions 22 received by a molded support fixture 40, fixture 40 then held to post 14 by ring clamp 26. The second embodiment illustrated shows extensions 22 continuous with a second bracing loop 21 which is annular and sized to semi-circumscribe post 14. Leg extensions 22 are held to post 14 by ring clamp 26 and further supported by loop 21. Obviously, in manufacture, only one leg extension type would be employed. The two described herein are merely illustrative.

Optional boot hooks 16 are shown attached to posts 14 above hosiery arms 20. Hooks 16 are provided so that a user may hang a boot by its loops from the two hooks and push his foot into the boot. Mounting of a boot, because of a boot's rigidity, is a different procedure than that described for hosiery and is described with reference to FIG. 7.

Also seen on posts 14 are proximal end caps 18 for better hand grip and distal end caps 28 which are preferably non-slip.

Now referring to FIGS. 4 and 5, preferred hinge 24 is illustrated. Hinge 24 is vertically adjustable for user comfort and is composed of two sets of adjustable pivot and holding hinge brackets 43 attached to the distal end of each post 14. Each set of brackets 43 includes a pair of mirror image brackets which surround post 14 at bracket area 25 and are joined at their extensions 31 by screws 27, thus completely surrounding post 14. Each joined set of brackets is then joined at their other ends to the other set of brackets by a shoulder screw 44, spacer washers 45, and nut 46. Brackets 43 include areas 29 which serve as spacers. The size of area 29 is determined so as to have posts 14 spaced sufficiently apart so that when their proximal ends are spread apart, as described in reference to FIG. 2, their distal ends, covered by caps 28, do not touch and interfere with the spreading.

Also seen in FIG. 4 are hosiery inversion arms 20 with leg extensions 22 and second bracing rings 21 mounted to posts 14 by ring clamps 26.

Now referring to FIGS. 2, 3, and 6, the use of stocking assist device 10 is illustrated, and in FIG. 6, the alternative hinge arrangement 52. In FIG. 2, a partial figure of a user, showing only two hands and a foot, illustrates how stocking assist device 10 is used. Stocking assist device 10 is seen with posts 14 and interior posts 15 extended to accommodate for a user's height, extensions 15 held at the desired height by locking coupler 19. Hosiery inversion arms 20 with leg extensions 22 are held on posts 14 by ring clamps 26 and braced by either support fixture 40 or bracing ring 21. End caps 18 and 28 are also shown. Alternative hinge 52 is seen joining posts 14 and is fully described with reference to FIG. 6.

Although in FIG. 2, and throughout the discussion, the hosiery described is a sock, it should be understood that device 10 is suitable for use with any hosiery, including socks, stockings, socked slippers, or the like. Device 10 is intended to solve the problem of mounting soft sided and limp foot garments which normally require bending and pulling to pull the garment up over the foot and onto the leg.

In use, one sock 38 at a time is placed over both hosiery inversion arms 20 by turning sock top 37 inside out over the tops 23 of arms 20. Sock toe 36 extends downward between arms 20 to form a cup. The sock heel (hidden in this view) faces the user. As the user grasps extensions 15 of posts 14 with hands 50, he spreads the posts in the direction indicated by arrows 56. This spreading action stretches open sock 38 at its top 37 to create a cup-type opening for foot 32. The user pushes foot 32 in the direction of arrow 34 into sock 38. As he pushes downward with foot 32 into sock 38, sock 38 is mounted onto his foot, inverted top 37 gradually turning towards the leg and unfolding. As sock top 37 reaches the user's calf, he spreads posts 15 further apart to give greater stretch to sock top 37, fitting sock 38 to the larger dimensions of his calf.

During the above described process, the user need not bend, nor does he pull with his arms. All motions are capable of being performed without bending the back or using lower back muscles. The user may be standing on one foot as illustrated, or he may be seated. If he is seated, device 10 is placed at an angled position with end caps 28 in contact with the floor, using device 10 in a manner similar to that described above for the standing position.

Now referring particularly to FIG. 3, a cross section taken on lines 3—3 of FIG. 2 shows in more detail the inversion of sock 38 on arms 20. Post 14 has hosiery inversion arm 20 which has top loop 23 and extensions 22 held in clamp 26. The importance of the inversion of sock 38 is illustrated in FIG. 3. Sock 38 is placed over opposing arms 20 with top 37 folded downward over arms 20 to form an inverted cuff, the inside 39 of sock 38 facing outward on the outside of arms 20. Sock outside 41 faces outward at toe portion 36. The length of sock which must now be mounted onto a foot has been decreased by the inversion process. Also, by inverting top 37, the downward pressure of a foot will turn sock 38 back to its correct position without a pulling motion by the user. As the user pushes downward with his foot, sock 38 gradually unrolls itself as it climbs his calf so that the foot and calf are surrounded by sock inside 39 and sock outside 41 is suitably facing outward.

Referring again to FIGS. 2 and 6, an alternative hinge arrangement 52 is illustrated. Each post 14 is fitted with a coiled hinge and spacer made of formed wire. There are preferably two complete rings and two half rings around each post. The first half ring ends in a straight section 55 which fits into a slot (unseen) in post 14 to hold the coiled hinge at the desired height on post 14. The second half ring has leg 57 which forms a spacer and extends towards the other post to terminate in coil 59. Both coils 59, one from each post 14, are joined in a pivot hinge arrangement by pivot bolt 62, nut 61, lock washers 60, and caps 63. Again, as with hinge 24, the length of the spacer section 57 (leg of coil 55) is important because it provides for sufficient degree of outward spreading of posts 14 during use. The hinge of FIG. 6 is simple to manufacture because it has relatively few parts.

Now referring to FIG. 7, optional boot hook 16 is illustrated showing a partial boot 72 hanging from boot strap 73. Hook 16 is seen to have leg 65 and ring 66. Ring 66 is formed to a slip fit so that when it is slipped over post 14 it may be moved to a desired position to hang tightly on post 14, not moving when foot pressure is given to boot 72. It is important that leg 65 extends outward at a sufficient degree to provide for rapid removal of boot strap 73 from hook 16.

Most tall boots are equipped with either interior or exterior loops proximate their top edges. In use, a person hangs a boot 72 by straps 73, one strap 73 on each hook 16 so that boot 72 hangs downward between posts 14. He pushes his foot downward into open end 74 of boot 72, and when his foot is completely inserted, he lifts his booted foot to pull straps 73 from hooks 16.

Although hooks 16 have been illustrated in detail, they are optional, the primary purpose of device 10 being an aid for mounting hosiery.

There are several variations which can be practiced in the scope of this invention. First, the type of hinge is determined by convenience and cost of manufacture.

Second, the boot hooks are optional, although desirable.

Also, telescoping posts have proved easy to operate and are desirable for length adjustment, but other lengthening means, or even unitary construction, are within the scope of the invention.

The hosiery mounting arms need not be loops, but could be solid and could also vary somewhat in shape as long as the size and shape accommodate conventional hosiery.

The stocking assist device can be made of many suitable materials, particularly aluminum because of its light weight and strength.

There are many advantages to the stocking assist device of this invention. Chiefly, it provides a quick and simple method of donning hosiery without bending the back or requiring outside help.

It is also inexpensive to manufacture and easy to operate and is adjustable for persons of different heights and physical capabilities.

Having now illustrated and described our invention, it is not intended that such description limit this invention, but rather that this invention be limited only by reasonable interpretation of the appended claims.

We claim:

1. A stocking assist device comprising:

(a) a pair of hingedly coupled, elongated, support posts, each said post having a proximal grasping end and a distal hinged end;

(b) a hinge connecting said posts adjacent their distal ends, said hinge inlcuding a spacer to prevent said distal ends from touching and interfering with the spreading of the hosiery; and (c) a pair of adjustable hosiery inversion arms mounted one on each said support post at one arm end between said proximal and said distal post ends in parallel and facing juxtaposition, said arms being presized to receive hosiery thereon, whereby when a piece of hosiery is placed over said arms with its open top inverted over both said arms simultaneously to form thereby a cup with said hosiery toe extending downward between said arms, a user may, by holding said posts at their proximal ends, one in each hand, and by spreading said posts apart, stretch said hosiery open to provide access for insertion of a foot into the hosiery.

2. The stocking assist device according to claim 1 further comprising an end cap on each post end.

3. The stocking assist device according to claim 1 wherein each said hosiery inversion arm includes an extension and a ring clamp for attaching said extension to said posts.

4. The stocking assist device according to claim 1 wherein each said hosiery inversion arm is an open ended elliptical loop, said loop open end including extensions for attachment to said post.

5. The stocking assist device according to claim 4 wherein each said loop open end of each hosiery inversion arm is continuous with a second loop, said second loop being annular and sized to semi-circumscribe said post.

6. The stocking assist device according to claim 1 wherein each said post includes, additionally, at its proximal end a telescoping rod and a locking coupler to hold said rod in a fixed position.

7. The stocking assist device according to claim 1 wherein said hinge is a pivoting hinge.

8. The stocking assist device according to claim 1 wherein each said post includes, on its distal end, a vertical slot and wherein said hinge is formed by coil-formed metal wire around each said post, a first wire end inserted into said slot, said wire coiled around said post and then extending outward from said post towards said other post to form said spacer, said wire terminating in at least one ring, and wherein said rings are held into a pivot pin by a cap.

9. The stocking assist device according to claim 1 further comprising a pair of boot hooks each having a free end, one said hook on each said post intermediate said hosiery inversion arm and said proximal post end, said hook end extending upward and inward from said post.

10. A stocking assist device comprising:

(a) a pair of hingedly coupled, elongated, support posts, each said post having a proximal grasping end and a distal hinged end;

(b) a pivot hinge connecting said posts adjacent their distal ends, said hinge including a spacer to prevent the distal ends from touching and interfering with the spreading of the hosiery; and, (c) a pair of hosiery inversion arms mounted one on each said support post in parallel and facing juxtaposition, each said arm sized to receive hosiery thereon and being a generally open-ended elliptical loop attached to said post on said loop open end, whereby when a stocking is placed over said arms with its open top inverted over both said arms simultaneously to form thereby a cup with said stocking toe extending downward between said arms, a user may, by holding said posts at their proximal ends, one in each hand, and by spreading said posts apart, stretch said stocking open to provide access for insertion of a foot into the stocking.

11. The stocking assist device according to claim 10 wherein each said post each includes, at its proximal end a telescoping rod and locking coupler.

12. The stocking assist device according to claim 10 wherein each said hosiery inversion arm is attached to said post by a ring clamp.

13. The stocking assist device according to claim 10 further comprising a non-slip end cap mounted on each post end.

14. The stocking assist device according to claim 10 wherein each said loop open end of each hosiery inversion arm is continuous with a second loop, said second loop being annular and sized to semi-circumscribe said post.

* * * * *